US008864260B1

(12) United States Patent
Ge et al.

(10) Patent No.: US 8,864,260 B1
(45) Date of Patent: Oct. 21, 2014

(54) EPROM STRUCTURE USING THERMAL INK JET FIRE LINES ON A PRINTHEAD

(71) Applicant: Hewlett-Packard Development Company, L.P., Houston, TX (US)

(72) Inventors: Ning Ge, Singapore (SG); Trudy Benjamin, Portland, OR (US); Teck Khim Neo, Singapore (SG)

(73) Assignee: Hewlett-Packard Development Company, L.P., Houston, TX (US)

( * ) Notice: Subject to any disclaimer, the term of this patent is extended or adjusted under 35 U.S.C. 154(b) by 69 days.

(21) Appl. No.: 13/870,123

(22) Filed: Apr. 25, 2013

(51) Int. Cl.
*B41J 29/38* (2006.01)
*B41J 2/045* (2006.01)

(52) U.S. Cl.
CPC ..... *B41J 2/04541* (2013.01)
USPC ..... 347/9

(58) Field of Classification Search
USPC ..... 347/9, 11, 12, 14, 16, 19, 20; 257/320; 365/185.2
See application file for complete search history.

(56) References Cited

U.S. PATENT DOCUMENTS

| | | | | |
|---|---|---|---|---|
| 5,859,796 | A * | 1/1999 | Cleveland | 365/185.2 |
| 6,533,384 | B1 | 3/2003 | Vega et al. | |
| 6,893,104 | B2 | 5/2005 | Tamura | |
| 7,044,572 | B2 | 5/2006 | Hirayama | |
| 7,345,915 | B2 * | 3/2008 | Benjamin | 365/185.14 |
| 7,365,387 | B2 * | 4/2008 | Benjamin | 257/320 |
| 2005/0231541 | A1 * | 10/2005 | Benjamin | 347/12 |
| 2011/0080454 | A1 | 4/2011 | Ghozeil et al. | |

OTHER PUBLICATIONS

Liou, Jian-Chium et al., Reduced 30% Scanning Time 3D Multiplexer Integrated Circuit Applied to Large Array Format 20KHZ Frequency Inkjet Print Heads, Sep. 28, 2008, 6 pages, http://arxiv.org/abs/0802.3079.

* cited by examiner

*Primary Examiner* — Kristal Feggins

(57) ABSTRACT

An integrated circuit (IC) erasable programmable read-only memory (EPROM) structure for a thermal inkjet printhead includes: a fire line to provide fire line data; a select line to provide selecting data; a firing cell coupled to the fire line; an EPROM cell coupled to the fire line; a selector cell coupled to the select line, the firing cell and the EPROM cell; and a data switching circuit to provide address data to the firing cell or the EPROM cell. The data switching circuit and the selector cell selectively enable transfer of the fire line data from the fire line to the firing cell or the EPROM cell as a function of state of the selecting data on the select line and the address data from the data switching circuit.

15 Claims, 4 Drawing Sheets

EPROM STRUCTURE USING THERMAL INK JET FIRE LINES ON A PRINTHEAD

BACKGROUND

In inkjet printing systems, it is desirable to have several characteristics of each print cartridge easily identifiable by a controller, and it is desirable to have such identification information supplied directly by the print cartridge. The "identification information", for example, can provide information to the printer controller to adjust the operation of the printer and ensure correct operation. A print cartridge can store this identification information using a small, non-volatile memory, such as an erasable programmable read-only memory (EPROM).

EPROMs can include a conductive grid of columns and rows. The cell at each intersection can have two gates that are separated from each other by an oxide layer that acts as a dielectric. One of the gates is called a "floating gate" and the other is called a control gate or input gate. The floating gate's only link to the row is through the control gate. A blank EPROM has all of the gates fully open, giving each cell a value of logic '0' (low resistance state). That is, the floating gate initially has no charge, which causes the threshold voltage to be low.

To change the value of the bit to logic '1' (high resistance state), a programming voltage is applied to the control gate and drain. The programming voltage draws excited electrons to the floating gate, thereby increasing the threshold voltage. The excited electrons are pushed through and trapped on the other side of the thin oxide layer, giving it a negative charge. These negatively charged electrons act as a barrier between the control gate and the floating gate. During use of the EPROM cell, a cell sensor can monitor the threshold voltage of the cell. If the threshold voltage is low (below the threshold level), the cell has a value of logic '0'. If the threshold voltage is high (above the threshold level), the cell as a value of logic '1'.

BRIEF DESCRIPTION OF THE DRAWINGS

Some embodiments of the invention are described with respect to the following figures.

DETAILED DESCRIPTION

EPROM structure using thermal ink jet fire lines on a printhead is described. In an example, EPROM cells are paired with thermal firing cells that are part of the ink drop ejectors. The firing cells receive firing energy from a plurality of fire lines on the printhead. The EPROM cells are also coupled to the fire lines to receive programming/reading energy. Selecting circuits are provided to selectively couple the firing cells or the EPROM cells to the fire lines.

In some structures, EPROM cells receive programming/reading energy from a single select line. The single select line is a bottleneck for programming and reading from the EPROM cells. Since the printhead includes a plurality of fire lines, programming/reading the EPROM cells using the fire lines increases performance (e.g., programming and reading time is reduced). Further, more EPROM cells can be included on the printhead, while taking up less real estate and less addressing time. Further, the firing lines can accommodate higher currents, which can accelerate reading/programming times (e.g., during manufacture and testing), reducing overall manufacturing cost.

Figure 1:
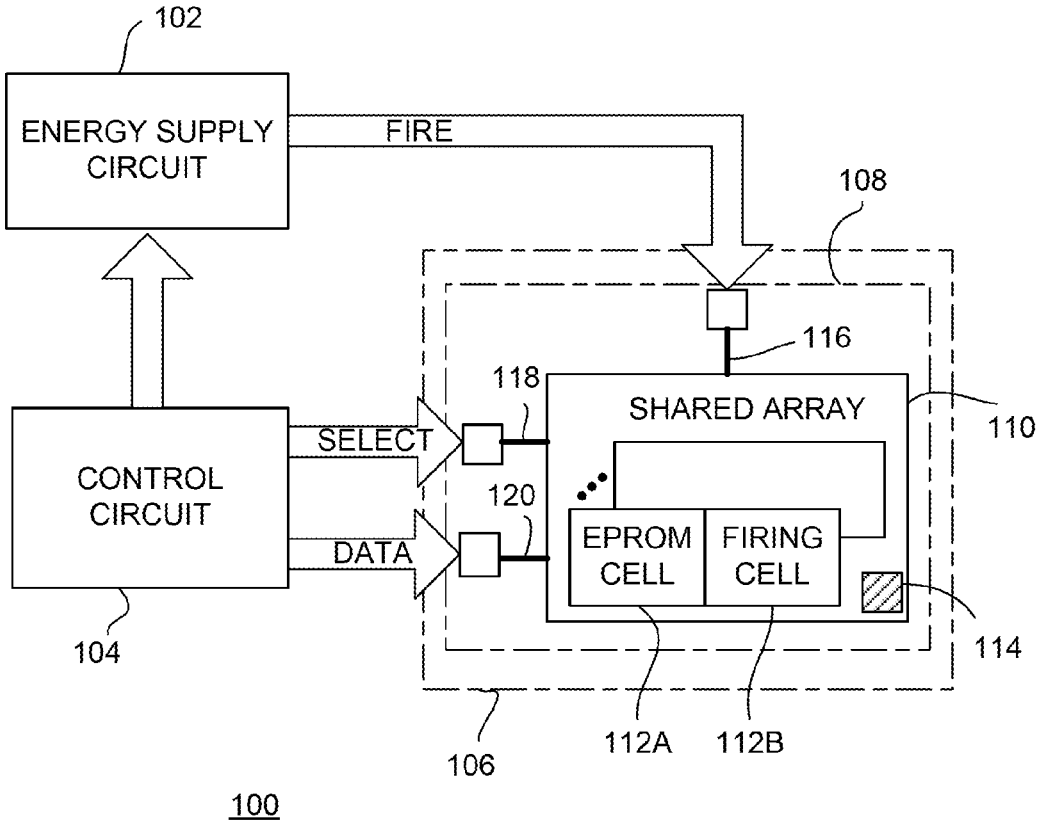
FIG. 1 is a block diagram of a printer system according to an example implementation.

FIG. 1 is a block diagram of a printer system 100 according to an example implementation. The printer system 100 includes an ink jet printing cartridge 106 having an ink jet printhead 108 that employs a shared array 110 of firing and erasable programmable read-only memory (EPROM) cells. The printer system 100 includes a control circuit 104 that provides address and/or control signals ("select data") and data signals ("energizing data") to the printhead 108. The control circuit 104 further controls an energy supply circuit 102 that provides signals for energizing firing cells in the shared array 110 ("fire signals" or "energizing energies"). The printhead 108 includes conductors for transferring the energizing energies ("fire lines 116"), conductors for transferring the energizing data ("data lines 120"), and conductors for transferring the select data ("select lines 118").

The printhead 108 can be a thin film structure fabricated using a semiconductor substrate having various thin film layers formed thereon (generally shown by box 108). The shared array 110 includes pairs of EPROM and firing cells 112A and 112B (collectively cells 112). The cells 112 can comprise NMOS structures. The thin film structure can be formed pursuant to known integrated circuit techniques, for example, as disclosed in commonly-assigned U.S. Pat. No. 5,635,968 and U.S. Pat. No. 5,317,346, both incorporated herein by reference. As described herein, the firing cells 112A include heater resistors that are used to heat ink in the printhead and eject ink drops therefrom. The EPROM cells 112*b* can be programmed to store bits of logic data (i.e., logic '1' or logic '0'), which can then be read.

The heater resistors in the firing cells 112A, and the EPROM cells 112*b*, are energized and programmed, respectively, using the same set of fire lines 116. The printhead 108 can include selecting/data switching circuits 114 coupled to the select lines 118 and the data lines 120. The selecting/data switching circuits 114 can select particular rows of cells 112, and selectively couple the firing cells 112A or the EPROM cells 112*b* to the fire lines 116, based on address data on the data lines 120 and selecting data on the select lines 118.

Figure 2:
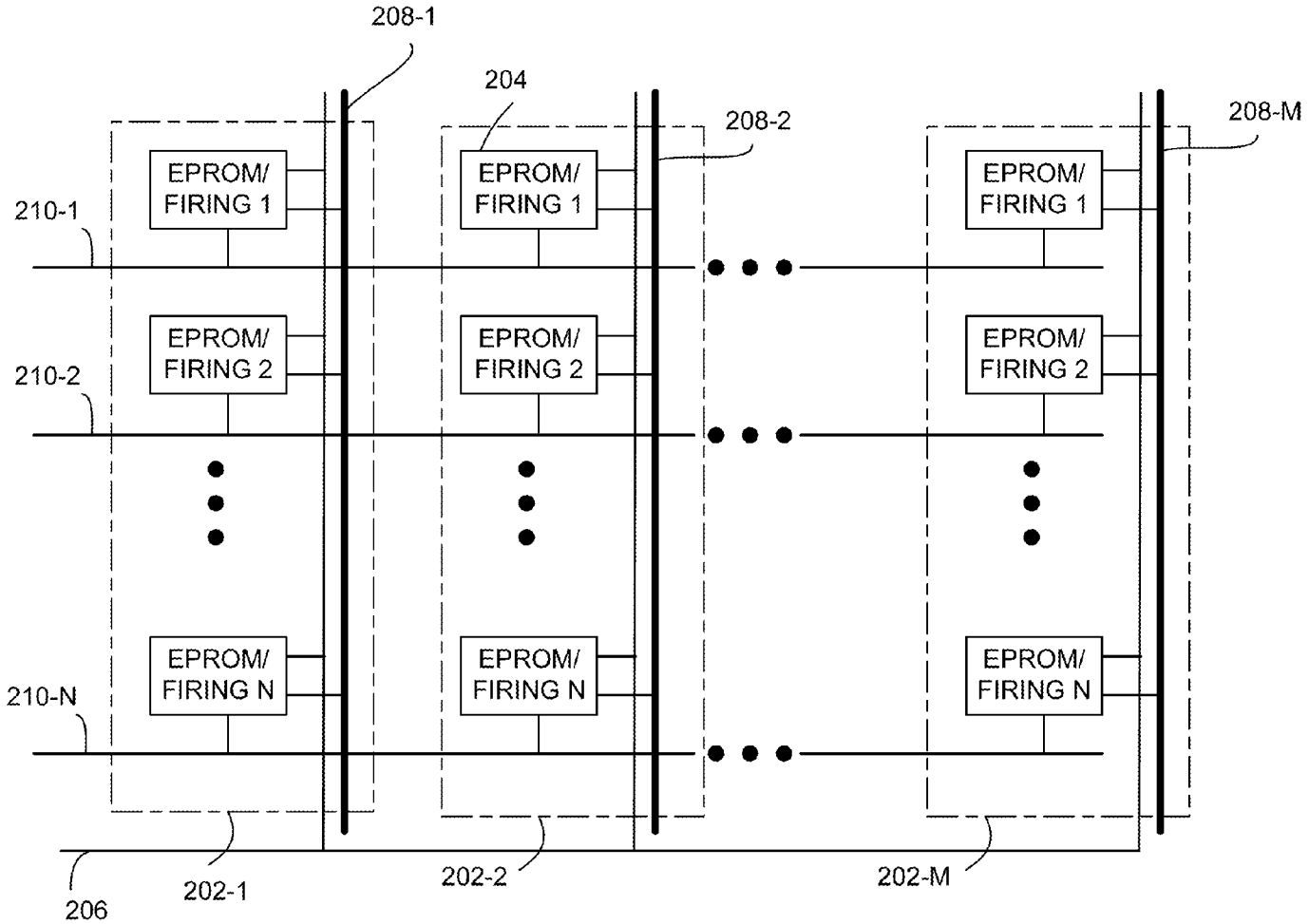
FIG. 2 is a block diagram of a shared firing cell and EPROM array according to an example implementation.

FIG. 2 is a block diagram of a shared firing cell and EPROM array ("shared array 200") according to an example implementation. The shared array 200 can be used on an ink jet printhead, such as the printhead 108 shown in FIG. 1 (e.g., the shared array 110). The shared array 200 includes columns 202-1 through 202-M (collectively "columns 202"), where M is an integer greater than zero. Each of the columns 202 includes N cells 204, where each cell 204 includes a firing cell and an EPROM cell (examples described below). The shared array 200 also includes fire lines 208-1 through 208-M (collectively "fire lines 208"). The cells 204 in each of the columns 202 are respectively coupled to the fire lines 208. The shared array 200 also includes a select line 206 coupled to each of the cells 204 in each of the columns 202. The shared array 200 further includes data lines 210-1 through 210-N (collectively "data lines 210"), where N is an integer greater than zero.

The select line 106 can transfer selecting data to the cells 204 in the shared array 200. The state selecting data determines whether the firing cells or EPROM cells are coupled to the fire lines 208. The data lines 210 can transfer address data to the cells 204. The state of the address data determines whether fire line data on the fire lines 208 is transferred to any given cell 204. Example structures for the cells 204 are described below.

Figure 3:
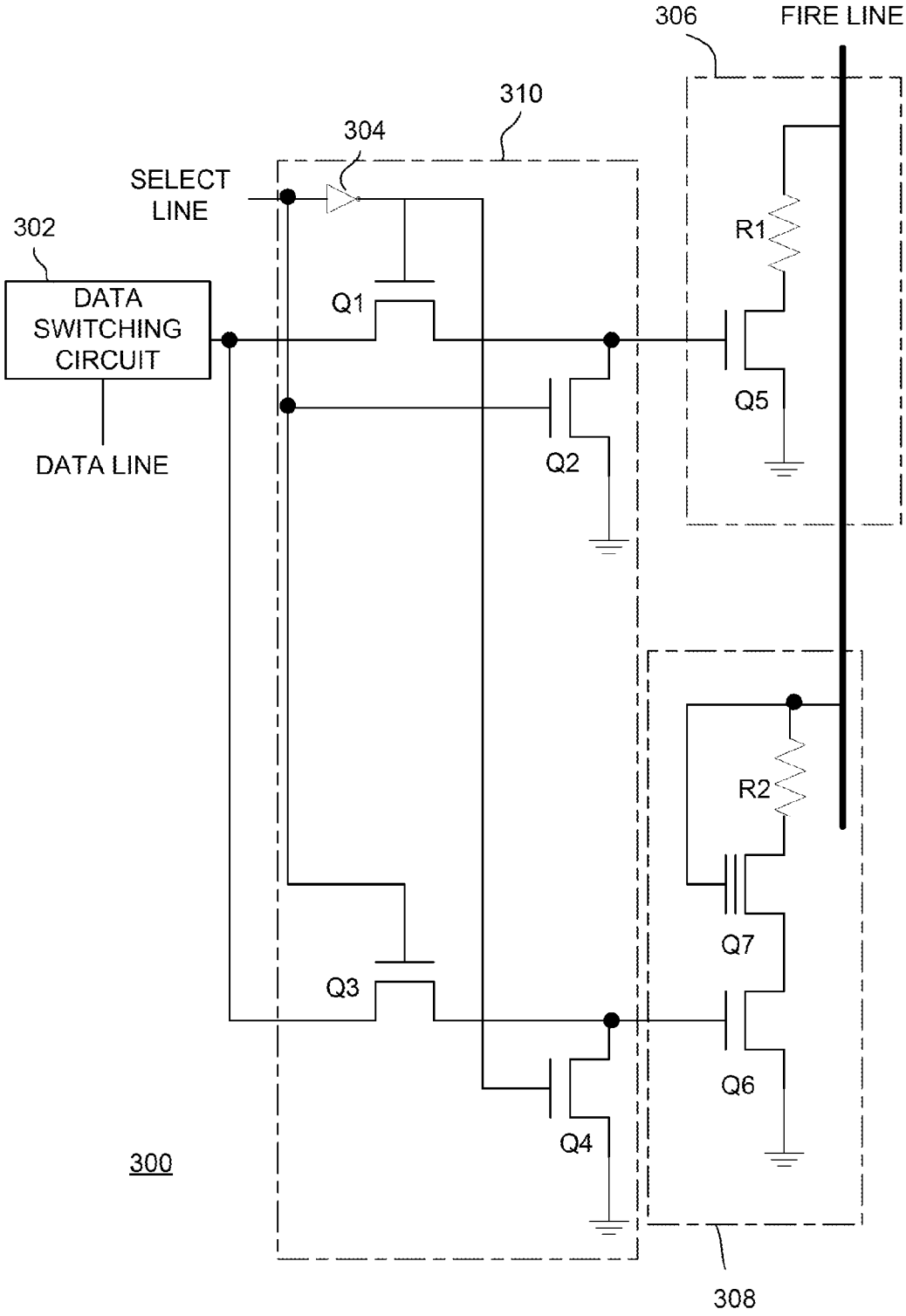
FIG. 3 is a schematic diagram of a shared firing/EPROM cell according to an example implementation.

FIG. 3 is a schematic diagram of a shared firing/EPROM cell 300 according to an example implementation. The cell 300 can be used in a shared array on an ink jet printhead, such as the shared array 200 described above (e.g., the cells 204). The cell 300 includes a firing cell 306, an EPROM cell 308, a select cell 310, and a data switching circuit 302. The data switching circuit 302 is coupled to a data line to receive address data. Output of the data switching circuit 202 is coupled to an input of the select cell 310. Another input of the select cell 310 is coupled to a select line to receive selecting data. Outputs of the select cell 310 are respectively coupled to inputs of the firing cell 306 and the EPROM cell 308. The firing cell 306 and EPROM cell 308 are further coupled to a fire line for receiving fire line data.

In operation, the state of the select data causes the select cell 310 to couple the firing cell 306 or the EPROM cell 308 to the fire line. The state of the address data enables selectively transfer of energy on the fire line to the selected cell (either the firing cell 306 or the EPROM cell 308). If the firing cell 306 is selected by the selecting data and the address data, the firing cell 306 can receive firing energy from the fire line to eject ink. If the EPROM cell 308 is selected by the selecting data and the address data, the EPROM cell 308 can receive energy from the fire line for programming or reading the EPROM cell 308.

In an example, transistors in the firing cell 306, the EPROM cell 308, and the select cell 310 can be n-channel field effect transistors (FETs), such as an n-type metal oxide semiconductor (NMOS) FETs. It is to be understood that other types of transistors can be used depending on the particular semiconductor process used to fabricate the printhead (e.g., p-type MOS or complementary MOS). For purposes of clarity by example, the transistors in FIG. 3 are shown and described as n-channel FETs.

The firing cell 306 includes a transistor Q5 and a resistor R1. One terminal of the resistor R1 is coupled to the fire line, and the other terminal of the resistor R1 is coupled to a drain of the transistor Q5. A source of the transistor Q5 is coupled to electrical ground. A gate of the transistor Q5 is coupled to the select cell 310. The resistor R1 is the heater resistor for firing cell 306. The transistor Q5 controls whether energy on the fire line is transferred through the resistor R1 in order to eject ink from the firing cell 306.

The EPROM cell 308 can include a resistor R2, a transistor Q6, and a floating-gate transistor Q7. One terminal of the resistor R2 is coupled to the fire line, and another terminal of the resistor R2 is coupled to a drain of the floating-gate transistor Q7. A gate of the floating-gate transistor Q7 is also coupled to the fire line. A source of the floating-gate transistor Q7 is coupled to a drain of the transistor Q6. A source of the transistor Q6 is coupled to electrical ground. A gate of the transistor Q6 is coupled to the select cell 310. The transistor Q6 controls whether the floating-gate transistor Q7 and resistor R2 receive energy from the fire line. The resistor R2 provides current limiting and voltage biasing for the floating gate transistor Q7. Operation of the floating-gate transistor for storing a "bit" of information is described above.

The select cell 310 includes a logical inverter 304 and transistors Q1 through Q4. The inverter 304 is coupled to the select line for logically inverting the selecting data. The drain of the transistor Q1 is coupled to the data switching circuit 302, and a source of the transistor Q1 is coupled to the gate of the transistor Q5 in the firing cell 306. A gate of the transistor Q1 is coupled to an output of the inverter 304. A drain of the transistor Q2 is coupled to the gate of the transistor Q5, and a source of the transistor Q2 is coupled to electrical ground. A gate of the transistor Q2 is coupled to the select line for receiving the select data. The transistor Q1 acts as a pass transistor that passes the address data from the data switching circuit to the firing cell 306 selectively based on the inverted select data. The transistor Q2 acts as a discharge transistor that turns off the transistor Q5 based on the select data. Thus, in this example, if the select data is logic '1', the transistor Q2 is on and the transistor Q5 in the firing cell is off. The transistor Q1 is also off and thus does not pass the address data to the firing cell 306. If the select data is logic '0', the transistor Q2 is off (no discharge) and the transistor Q1 is on (pass through). Thus, the address data is passed to the transistor Q5 to selectively activate the firing cell 306.

The select cell 310 includes a similar structure coupled to the EPROM cell 308. That is, the drain of the transistor Q3 is coupled to the data switching circuit 302, and a source of the transistor Q3 is coupled to the gate of the transistor Q6 in the EPROM cell 308. A gate of the transistor Q3 is coupled to the select line. A drain of the transistor Q4 is coupled to the gate of the transistor Q6, and a source of the transistor Q4 is coupled to electrical ground. A gate of the transistor Q4 is coupled to the output of the inverter 304 for receiving the inverted select data. The transistor Q3 acts as a pass transistor that passes the address data from the data switching circuit to the EPROM 308 selectively based on the select data. The transistor Q4 acts as a discharge transistor that turns off the transistor Q6 based on the inverted select data. Thus, in this example, if the select data is logic '1', the transistor Q4 is off (no discharge) and the transistor Q3 is on (pass through). Thus, the address data is passed to the transistor Q6 to selectively activate the EPROM cell 308. If the select data is logic '0', the transistor Q4 is on and the transistor Q6 in the EPROM cell 308 is off. The transistor Q3 is also off and thus does not pass the address data to the EPROM cell 308. Thus, either the firing cell 306 or the EPROM cell 308 is enabled to receive fire line data based on state of the select data and the address data.

Figure 4:
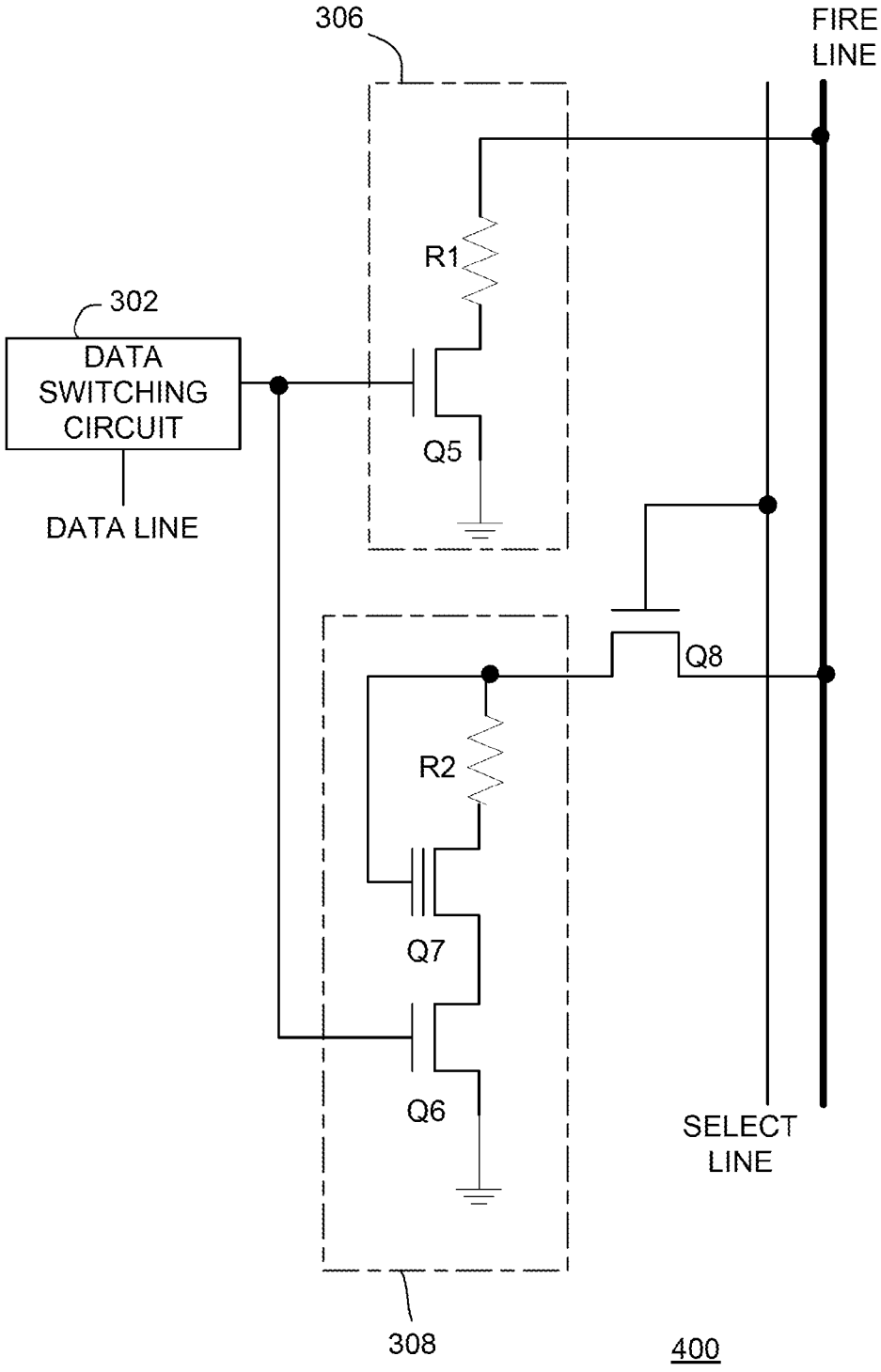
FIG. 4 is a schematic diagram of another shared firing/EPROM cell according to an example implementation.

FIG. 4 is a schematic diagram of another shared firing/EPROM cell 400 according to an example implementation. The cell 400 can be used in a shared array on an ink jet printhead, such as the shared array 200 described above (e.g., the cells 204). Elements of the cell 400 that are the same or similar to those of FIG. 3 are described in detail above. In the present example, a transistor Q8 acts as a select cell for the cell 400. A drain of the transistor Q8 is coupled to the fire line, a source of the transistor Q8 is coupled to the EPROM cell 308, and a gate of the transistor Q8 is coupled to the select line. If the select data is logic '0', the transistor Q8 is off and the EPROM cell 308 is uncoupled from the fire line. If the select data is logic '1', the transistor Q8 is on and the EPROM cell 308 is coupled to the fire line. The transistor Q8 isolates the EPROM cell 308 from the fire line and high-energy signals used to activate the firing cell 306. When the EPROM cell 308 is coupled to the fire line, the low energy signal used to program and/or read the EPROM cell 308 can be such that the fire cell 306 is not activated.

In the foregoing description, numerous details are set forth to provide an understanding of the present invention. However, it will be understood by those skilled in the art that the present invention may be practiced without these details. While the invention has been disclosed with respect to a limited number of embodiments, those skilled in the art will appreciate numerous modifications and variations therefrom.

It is intended that the appended claims cover such modifications and variations as fall within the true spirit and scope of the invention.

What is claimed is:

1. An integrated circuit (IC) erasable programmable read-only memory (EPROM) structure for a thermal inkjet printhead, comprising:

a fire line to provide fire line data;

a select line to provide selecting data;

a firing cell coupled to the fire line;

an EPROM cell coupled to the fire line;

a selector cell coupled to the select line, the firing cell and the EPROM cell; and a data switching circuit to provide address data to the firing cell or the EPROM cell;

where the data switching circuit and the selector cell selectively enable transfer of the fire line data from the fire line to the firing cell or the EPROM cell as a function of state of the selecting data on the select line and the address data from the data switching circuit.

2. The IC EPROM structure of claim 1, wherein the selector cell comprises:

a logical inverter coupled to the select line to provide logically inverted selecting data;

a firing cell selector circuit having a first input coupled to the data switching circuit, second and third inputs respectively coupled to the selecting data and the logically inverted selecting data, and an output coupled to the firing cell; and an EPROM cell selector circuit having a first input coupled to the data switching circuit, second and third inputs respectively coupled to the selecting data and the logically inverted selecting data, and an output coupled to the EPROM cell.

3. The IC EPROM structure of claim 2, wherein each of the firing cell selector circuit and the EPROM cell selector circuit includes a pass field effect transistor (FET) and a discharge FET.

4. The IC EPROM structure of claim 1, wherein the selector cell comprises:

a switch having a first input coupled to the fire line, a second input coupled to the select line, and an output coupled to the EPROM cell.

5. The IC EPROM of claim 4, wherein the switch includes a field effect transistor (FET).

6. An integrated circuit (IC) erasable programmable read-only memory (EPROM) structure for a thermal inkjet printhead, comprising:

fire lines to provide fire line data;

a select line to provide selecting data;

a plurality of cells disposed in rows and columns, each cell coupled to one of the fire lines and the select line, each cell including:

a firing cell;

an EPROM cell;

a selector cell; and a data switching circuit to provide address data to the firing cell or the EPROM cell;

where the data switching circuit and the selector cell selectively enable transfer of the fire line data from a respective fire line to the firing cell or the EPROM cell as a function of state of the selecting data on the select line and the address data from the data switching circuit.

7. The IC EPROM structure of claim 6, wherein the selector cell comprises:

a logical inverter coupled to the select line to provide logically inverted selecting data;

a firing cell selector circuit having a first input coupled to the data switching circuit, second and third inputs respectively coupled to the selecting data and the logically inverted selecting data, and an output coupled to the firing cell; and an EPROM cell selector circuit having a first input coupled to the data switching circuit, second and third inputs respectively coupled to the selecting data and the logically inverted selecting data, and an output coupled to the EPROM cell.

8. The IC EPROM structure of claim 7, wherein each of the firing cell selector circuit and the EPROM cell selector circuit includes a pass field effect transistor (FET) and a discharge FET.

9. The IC EPROM structure of claim 6, wherein the selector cell comprises:

a switch having a first input coupled to the fire line, a second input coupled to the select line, and an output coupled to the EPROM cell.

10. The IC EPROM of claim 9, wherein the switch includes a field effect transistor (FET).

11. A printhead, comprising:

a semiconductor substrate;

firing cells formed in the substrate each having a heater resistor;

erasable programmable read-only memory (EPROM) cells formed in the substrate each having a floating-gate field effect transistor (FET);

fire lines formed using conductors patterned on the substrate to receive fire line data; and selector cells formed in the substrate controllable to selectively enable transfer of the fire line data to the firing cells or the EPROM cells.

12. The printhead of claim 11, further comprising:

a select line formed using the conductors to receive selecting data and coupled to each of the selector cells;

data lines formed using the conductors to receive address data; and data switching circuits coupled to the data lines;

where the data switching circuits and the selector cells selectively enable transfer of the fire line data from the fire lines to the firing cells or the EPROM cells as a function of state of the selecting data on the select line and the address data on the data lines.

13. The printhead of claim 12, wherein each of the selector cells comprises:

a logical inverter coupled to the select line to provide logically inverted selecting data;

a firing cell selector circuit having a first input coupled to a respective data switching circuit, second and third inputs respectively coupled to the selecting data and the logically inverted selecting data, and an output coupled to a respective firing cell; and an EPROM cell selector circuit having a first input coupled to the respective data switching circuit, second and third inputs respectively coupled to the selecting data and the logically inverted selecting data, and an output coupled to a respective EPROM cell.

14. The printhead of claim 13, wherein each of the firing cell selector circuit and the EPROM cell selector circuit includes a pass field effect transistor (FET) and a discharge FET.

15. The printhead of claim 12, wherein each of the selector cells comprises:

a switch having a first input coupled to a respective fire line, a second input coupled to the select line, and an output coupled to a respective EPROM cell.

* * * * *